US007666476B2

(12) United States Patent
Chandra et al.

(10) Patent No.: US 7,666,476 B2
(45) Date of Patent: Feb. 23, 2010

(54) PROCESS OF METALLIZING POLYMERIC FOAM TO PRODUCE AN ANTI-MICROBIAL AND FILTRATION MATERIAL

(75) Inventors: N. Satish Chandra, Lansdale, PA (US); Joel M. Furey, Stowe, VT (US); William F. McNally, Clarks Summit, PA (US); Vinesh Naik, DuPont, PA (US)

(73) Assignee: Noble Fiber Technologies, LLC, Scranton, PA (US)

( * ) Notice: Subject to any disclaimer, the term of this patent is extended or adjusted under 35 U.S.C. 154(b) by 359 days.

(21) Appl. No.: 11/209,567

(22) Filed: Aug. 23, 2005

(65) Prior Publication Data

US 2007/0281093 A1 Dec. 6, 2007

Related U.S. Application Data

(60) Provisional application No. 60/603,610, filed on Aug. 23, 2004.

(51) Int. Cl.
*B05D 3/10* (2006.01)
*B05D 1/18* (2006.01)

(52) U.S. Cl. ..... 427/304; 427/299; 427/301; 427/322; 427/431

(58) Field of Classification Search ..... 427/299, 427/301, 304, 322, 431, 243
See application file for complete search history.

(56) References Cited

U.S. PATENT DOCUMENTS

| | | | | |
|---|---|---|---|---|
| 3,877,965 | A | 4/1975 | Broadbent et al. | |
| 4,687,553 | A * | 8/1987 | Solomon et al. | 205/65 |
| 4,941,940 | A * | 7/1990 | Patel et al. | 216/87 |
| 5,482,738 | A * | 1/1996 | Imhof et al. | 427/305 |
| 5,747,178 | A * | 5/1998 | Sodervall et al. | 428/624 |
| 6,395,402 | B1 * | 5/2002 | Lambert et al. | 428/550 |
| 6,645,557 | B2 * | 11/2003 | Joshi | 427/304 |
| 2003/0175497 | A1 * | 9/2003 | Kobe et al. | 428/317.9 |
| 2004/0173056 | A1 * | 9/2004 | McNally et al. | 75/721 |
| 2004/0258914 | A1 * | 12/2004 | Chandra et al. | 428/375 |
| 2005/0123621 | A1 * | 6/2005 | Burton et al. | 424/618 |

FOREIGN PATENT DOCUMENTS

| | | | |
|---|---|---|---|
| EP | 1 130 154 | | 9/2001 |
| EP | 1235473 | A1 * | 8/2002 |
| WO | WO 00/75395 | | 12/2000 |
| WO | WO 2004/027113 | | 4/2004 |

* cited by examiner

*Primary Examiner*—Timothy H Meeks
*Assistant Examiner*—Cachet I Sellman
(74) *Attorney, Agent, or Firm*—Michael K. Dixon; Akerman Senterfitt

(57) ABSTRACT

A method of producing a metallized polymeric foam that produces an anti-microbial material using an advanced method of metallizing polymeric foam with a metal, such as silver. The foam material may be polyurethane, polyester, polyether, or a combination thereof. The method provides a 3-dimensional surface coating of the metal. The metallized substrate is durable and highly adherent. Such metallized foam is a highly effective filter and/or an anti-microbial product. The mechanism of filtration is mainly due to Vander Der Wal attraction. The anti-microbial activity may be due, in part, to the release of select metal ions as a response to stimuli.

5 Claims, No Drawings

PROCESS OF METALLIZING POLYMERIC FOAM TO PRODUCE AN ANTI-MICROBIAL AND FILTRATION MATERIAL

CROSS REFERENCE TO RELATED APPLICATIONS

The present application claims priority to U.S. Provisional Patent Application No. 60/603,610, which was filed Aug. 23, 2004 and which is hereby incorporated by reference in its entirety.

FIELD OF THE INVENTION

This invention is directed generally to forming anti-microbial materials, and more particularly to forming foam materials having anti-microbial activity and/or filtration properties.

BACKGROUND

There are several prior art methods that describe metallizing of foam substrates (e.g., Pat. Nos.: 6,395,402; 5,151,222; 3,661,597). Different methods have been used to metallize foam for various applications such as EMI shielding etc. Pat. No. 6,395,402 discuss the metallization of copper/nickel for EMI applications. While the adhesion of the metal to the foam may be good, the process cannot produce a good silver coating due to the difference in deposition rates of copper versus silver. In addition, these materials do not provide any-microbial activity as copper/nickel do not provide anti-microbial properties. The other patents listed produce rigid foam that cannot be used in a medical/anti-microbial application(s) or as a flexible filter.

Accordingly, what is needed is a method of metallizing foam that is capable of using silver. Also what is needed is a method of forming a foam material that has anti-microbial activity. Additionally what is needed is a method of forming a foam material that may be used as a filter and having anti-microbial activity.

SUMMARY OF THE INVENTION

The present invention provides a method of metallizing a foam material. The method may be used to form a foam material having anti-microbial activity by metallizing the foam with a metal, such as silver. The resulting foam may be used in a variety of different applications such as a filter material. The methods of the present invention are simpler than prior art methods since the foam materials may be metallized without the need for an activation/seeding step. The resulting foam may also be designed such that the product has a low resistance and/or an optimal metal ion release. The method of the present invention uses one or more of the steps of etching the foam, pre-metallizing the foam and metallizing the foam with silver. Depending on the selected properties of the final foam, the method may use some or all of these steps.

These and other embodiments are described in more detail below.

DETAILED DESCRIPTION OF THE INVENTION

The present invention is more particularly described in the following description and examples that are intended to be illustrative only since numerous modifications and variations therein will be apparent to those skilled in the art. As used in the specification and in the claims, the singular form "a," "an," and "the" may include plural referents unless the context clearly dictates otherwise. Also, as used in the specification and in the claims, the term "comprising" may include the embodiments "consisting of" and "consisting essentially of."

The present invention provides a method of metallizing a foam material. The method may be used to form a foam material having anti-microbial activity by metallizing the foam with a metal that provides anti-microbial activity to a material. The resulting foam may be used in a variety of different applications that may benefit from a material having anti-microbial activity including, but not limited to, the use of the metallized foam as a filter material. The methods of the present invention are simpler than prior art methods because the foam materials may be metallized without an activation/seeding step commonly associated with prior art methods. The resulting metallized foam materials are formed such that the metal adheres well to the foam. The resulting foam may be designed such that the product has a low resistance and/or an optimized silver ion release.

The methods of the present invention are designed to metallize foam without the need for an activator. As such, the methods of the present invention are capable of metallizing the film through one or more of the steps of etching the foam, pre-metallizing the foam and/or metallizing the foam with the selected metal. Depending on the selected properties of the final foam, one or more of these steps may be omitted while still achieving a metallized foam product. As used herein, an "etchant" is a material capable of etching or removing portions of the foam material to permit better adhesion of the metal to the foam substrate to be metallized.

Accordingly, in a first aspect, the methods of the present invention etch the foam to increase the surface area of the foam. To etch the foam, the foam substrate is first quenched using an etchant and then rinsed. The etchant may be, in one embodiment, a base solution. The type of base solution may be any base solution capable of removing or etching portions of the foam substrate. The type of base solution that may be used may vary depending on one or more factors including, but not limited to, the foam substrate to be etched, the metal to be applied, the degree of etching desired, and/or the final characteristics of the metallized foam. Examples of base solutions that may be used for the etchant include, but are not limited to, alkaline hydroxides, such as lithium hydroxide, sodium hydroxide, potassium hydroxide, rubidium hydroxide, cesium hydroxide, francium hydroxide, beryllium hydroxide, magnesium hydroxide, calcium hydroxide, strontium hydroxide, barium hydroxide, or a combination thereof. In one embodiment, the base solution is sodium hydroxide.

The foam may be etched by immersing the foam substrate in a solution containing the etchant. As used herein, "immersed" is meant to include any method by which a solution may be contacted with at least a portion of a surface area of a foam substrate including, but not limited to, dipping, spraying, immersing, quenching, and/or any other method capable of applying a liquid to at least a portion of a substrate.

In one embodiment, the first step in the process may be performed either immediately prior to the second step or may be performed as a preparation step with subsequent steps taking place at a future time. As such, thicker foams and/or extended amounts of foam may be treated in a mass processing step. This would enable a manufacturer to quench thick foam (1' thick) and 12 feet or more of length at a time. Alternatively, flame-treated non-etched foam may be etched in-house using a stronger solution of sodium hydroxide.

The first etching step may be performed under a range of operating temperatures and/or dwell or etch times, depending on the type of foam to be etched, the etchant used, and/or the selected characteristics of the finished product. Various embodiments for the methods of the present invention are set forth below, although it is to be understood that other embodiments are also included within the scope of the present invention. For the percentage of the foam that is etched:

| | Etching % |
|---|---|
| First Embodiment | 3-75 |
| Second Embodiment | 10-50 |
| Third Embodiment | 15-40 |
| Fourth Embodiment | ~25 |

For the temperature at which the process is to be operated:

| | Temperature range ° C. |
|---|---|
| First Embodiment | 10-60 |
| Second Embodiment | 15-50 |
| Third Embodiment | 20-40 |
| Fourth Embodiment | ~30 |

For the etch time of the process:

| | Etch Time in Minutes |
|---|---|
| First Embodiment | 1-45 |
| Second Embodiment | 10-30 |
| Third Embodiment | 15-30 |
| Fourth Embodiment | ~25 |

The temperature and time of etch may be dependent on the concentration of the etchant solution.

After the foam has been etched, the foam may be conditioned with a non-ionic surfactant or other suitable material to enable the surface to be wet out and/or to clean the surface of any debris/dirt. A good rinsing process using de-ionized water with temperature under 70° C. follows may be used with the following embodiments:

| | Temperature of DI Water |
|---|---|
| First Embodiment | 5-70 |
| Second Embodiment | 10-50 |
| Third Embodiment | 20-40 |
| Fourth Embodiment | ~30 |

Some polyether foams may not be etched since the chemistry as described below is sufficient to activate the surface of the foam material. As a result, for the methods of the present invention, when a polyether foam is used as the foam substrate, the foams may be metallized without the need for an activation/seeding step or an etching step for preparing the foam for metallization.

After the step of etching the foam, then the methods of the present invention may include a pre-metallization step. The pre-metallization step is utilized to prepare the foam for the application of the metal and to help facilitate attachment of the metal to the foam substrate. In one embodiment, the pre-metallization step may be accomplished by dipping the etched foam in an acid solution. An acid dip, such as with HCl, may then be used. The acid dip acts as a pre-metallizing step utilizing the acid as the solvent. Other acids, such as sulfuric acid or nitric acid, may be used for the pre-metallization step. A rinsing step may then be used upon completion of the pre-metallizing step.

For the dwell times of the pre-metallizing step, various embodiments are set forth below:

| | Dwell Time in acid (minutes) |
|---|---|
| First Embodiment | 1-35 |
| Second Embodiment | 3-30 |
| Third Embodiment | 5-20 |
| Fourth Embodiment | ~15 |

For the concentration of the acid in the pre-metallizing step, various embodiments include:

| | Concentration of acid (%) |
|---|---|
| First Embodiment | 0.5-35 |
| Second Embodiment | 1-20 |
| Third Embodiment | 3-18 |
| Fourth Embodiment | ~15 |

The pre-metallization step may, in one embodiment, provide a mixture of stannous chloride and muriatic acid. The amount of stannous chloride may be, in one embodiment, selected to be between about 60 gm/l up to about 140 gm/l and the concentration of the muriatic acid may be between about 6 to about 15%. The dwell time may be selected to be between about 3 and 15 minutes. Once the pre-metallization step is completed, the process may be followed by a special counter flow rinsing with controlled water flow. This step enables the acid to remove any excess salts and acids from the substrates yet leave an optimum amount of activators on the surface. For the concentration of the muriatic acid, various embodiments are set forth below:

| | Concentration of acid (%) |
|---|---|
| First Embodiment | 4-25 |
| Second Embodiment | 5-20 |
| Third Embodiment | 8-18 |
| Fourth Embodiment | ~10 |

For the concentration of the stannous chloride, various embodiments are set forth below:

| | Concentration of Stannous Chloride |
|---|---|
| First Embodiment | 5-40 |
| Second Embodiment | 10-30 |
| Third Embodiment | 20-25 |
| Fourth Embodiment | ~10 |

For the dwell time, various embodiments for the present invention may include:

| | Dwell time in minutes |
|---|---|
| First Embodiment | 5-60 |
| Second Embodiment | 10-50 |
| Third Embodiment | 20-30 |
| Fourth Embodiment | ~10 |

It is to be understood that embodiments for the concentration of the acid, the concentration of the stannous chloride and/or the dwell time are not required to be used in the order listed above in the respective tables, but may be used in any order or combination thereof. Accordingly, in one embodiment, the concentration of the acid may be from about 5 to about 20%, the concentration of the stannous chloride may be about 10%, and the dwell time may be from about 5 to about 60 minutes. Alternatively, in another embodiment, the concentration of the acid may be from about 8 to about 18%, the concentration of the stannous chloride may be from about 5 to about 40%, and the dwell time may be from about 10 to about 50 minutes.

Once the foam has been prepared, the methods of the present invention then include a final step of applying the metal to the foam. The step may be referred to as a metallization step. The metallization step may be performed using known metallization technologies such as those described in U.S. Pat. No. 3,877,965 or patent application Ser. No. 10/666,568, which are hereby incorporated by reference.

The metallized foam may then be placed in an oven at 60-70° C. for about 30 minutes to produce a semi-quenching effect to help attach the metal to the foam.

The methods of the present invention may be used with a variety of different metals that may be desired to be attached to a foam substrate. In one embodiment, the metal is silver. Silver provides anti-microbial, conductive and/or anti-static properties to the foam substrate. In alternative embodiments, the metal may be selected from copper, gold, aluminum, or any other metal capable of being attached to a foam substrate.

The present invention may be used with any type of foam. Examples of foams that may be used include, but are not limited to, polyurethane, polyester, polyether, or a combination thereof. The resulting foams have enhanced resistance (ohms/square), anti-microbial activity, ion release, or a combination thereof, as compared to prior art foams.

The metallized foam products made according to the methods of the present invention may be used in any application wherein the advantages offered by the metal may be utilized. For example, due to the anti-microbial benefits, if the metal is silver, the metallized foam may be used as a filter material for the filtration of liquids. In addition, the foam may be in the form of a thin layer, such that the resulting metallized foam may be used as a wrap for wounds to assist in healing of the wounds.

The present invention will now be further described through examples. It is to be understood that these examples are non-limiting and are presented to provide a better understanding of various embodiments of the present invention.

EXAMPLES

Example 1

A bath was prepared by dissolving 4.2 gm of silver nitrate in de-ionized water. It was then complexed with 3.3 ml of 27% aqua ammonia. A quenched foam sample weighing 24.0 gm was cleaned with non-ionic surfactant such as Triton X-100 and rinsed thoroughly. Foam was etched with 15% HCl for 20 minutes. The foam was then pre-metallized with solution having 10% HCl and 10 gm/l of anhydrous tin chloride for 20 minutes. The foam was then rinsed in counter flow de-ionized water. 0.63 gm of tetra sodium EDTA was dissolved in 2 liters of de-ionized water. 6.5 ml of NEL/AEM surfactant was also added to the bath. The foam was placed in the reactor and solution was agitated. Silver complex was added and then 1.8 ml of formaldehyde was added. After three hours the sample was removed and subjected to hot water rinse. Then a 0.2% NaOH solution was (50 mL volume) was made up and at 60° C. The metallized foam was then dipped into the solution. The color changed to a gold tone.

Example 2

The sample obtained from example 1 cut to produce a 1.5 gm sample. This was then placed in a beaker with 5% sodium chloride solution for 24-hour period at 37° C. The solution after 1-hour period was then tested for silver ions using a Perkin Elmer Analyst 300. The ion release was 0.5 ppm

Example 3

The sample obtained from example 1 was cut to weight 0.75 gm and was subjected to Dow Corning Corporate Test Method 0923 and/or ASTM-E2149 Test method. The organism used was *Staphylococcus aureus* ATCC 6538. The reduction of organism growth was over 99.9%.

Example 4

The Sample obtained from example 1 was subject to process similar to the one described in U.S. patent application Ser. No. 10/836,530, the disclosure of which is hereby incorporated by reference in its entirety. This sample was then subjected to the ion release protocol as described in example 2. The ion release was at 6.2 ppm in one hour

Example 5

The sample obtained from example 1 was subject to ASTM E-2149 test for antimicrobial efficacy. The organism used was *Staphylococcus aureus* ATCC 6538. The reduction of organism growth was over 99.9%.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A method for metallizing a polyether foam comprising the steps of:

pre-metallizing a polyether foam substrate to prepare the foam substrate for application of a metal by using a mixture of stannous chloride and an acid and immersing the foam substrate in the mixture; and metallizing the foam substrate to apply the metal to the foam;

wherein the method does not require an etching step or any additional step.

2. The method of claim 1, wherein the foam substrate is immersed in the mixture for a period of time from about 5 to about 60 minutes.

3. The method of claim 1, wherein the mixture includes from about 5 to about 40% of stannous chloride and from about 4 to about 25% of the acid.

4. The method of claim 1, wherein the metal is selected from silver, gold, aluminum, copper, or a combination thereof.

5. The method of claim 4, wherein the metal comprises silver.

* * * * *